US012546218B2

(12) United States Patent
Jones et al.

(10) Patent No.: US 12,546,218 B2
(45) Date of Patent: Feb. 10, 2026

(54) LARGE COUNT MICROSAMPLER

(71) Applicant: Halliburton Energy Services, Inc., Houston, TX (US)

(72) Inventors: Christopher Michael Jones, Houston, TX (US); Darren George Gascooke, Houston, TX (US); Anthony Herman VanZuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 334 days.

(21) Appl. No.: 18/307,875

(22) Filed: Apr. 27, 2023

(65) Prior Publication Data

US 2024/0068366 A1 Feb. 29, 2024

Related U.S. Application Data

(60) Provisional application No. 63/388,787, filed on Jul. 13, 2022.

(51) Int. Cl.
*E21B 49/08* (2006.01)

(52) U.S. Cl.
CPC ..... *E21B 49/081* (2013.01); *E21B 49/08* (2013.01); *E21B 49/088* (2013.01)

(58) Field of Classification Search
CPC ..... E21B 49/08; E21B 49/081; E21B 49/088
See application file for complete search history.

(56) References Cited

U.S. PATENT DOCUMENTS

| | | | | |
|---|---|---|---|---|
| 3,384,170 | A | 5/1968 | Van Poollen | |
| 6,062,073 | A | 5/2000 | Patton et al. | |
| 8,826,981 | B2 * | 9/2014 | van Hal | E21B 49/081 166/250.12 |
| 10,294,783 | B2 | 5/2019 | Jones et al. | |
| 11,506,051 | B2 | 11/2022 | Olapade et al. | |
| 11,555,401 | B2 | 1/2023 | Jones et al. | |
| 2004/0216874 | A1 | 11/2004 | Grant et al. | |
| 2004/0244971 | A1 * | 12/2004 | Shammai | G01N 33/2823 166/250.1 |
| 2008/0156486 | A1 | 7/2008 | Ciglenec et al. | |
| 2009/0211756 | A1 | 8/2009 | Goodwin et al. | |

(Continued)

FOREIGN PATENT DOCUMENTS

| | | |
|---|---|---|
| CN | 113503159 | 10/2021 |
| KR | 10-2016-0000599 | 1/2016 |

OTHER PUBLICATIONS

International Search Report and Written Opinion for International Patent Application No. PCT/US2023/023996 dated Sep. 19, 2023.

*Primary Examiner* — Jill E Culler
(74) *Attorney, Agent, or Firm* — Benjamin Ford; C. Tumey Law Group PLLC

(57) ABSTRACT

A microsampling device for taking fluid samples in a wellbore. The microsampling device may comprise a microsampling tube in which one or more microsamplers disposed in the microsampling tube. Additionally, the microsampling device may comprise a fluid flow line connected to the microsampling tube in which a fluid sample traverses and a secondary fluid flow line in which at least a part of the fluid sample may traverse from the microsampling tube through the secondary fluid flow line and into a wellbore.

19 Claims, 13 Drawing Sheets

(56) References Cited

U.S. PATENT DOCUMENTS

| | | | | |
|---|---|---|---|---|
| 2010/0175467 | A1* | 7/2010 | DiFoggio ..... | E21B 49/081 73/152.28 |
| 2013/0068940 | A1 | 3/2013 | Jones et al. | |
| 2014/0027105 | A1 | 1/2014 | Irani | |
| 2014/0309959 | A1 | 10/2014 | Shen et al. | |
| 2014/0345848 | A1 | 11/2014 | Irani | |
| 2015/0176403 | A1 | 6/2015 | Chen et al. | |
| 2016/0258279 | A1 | 9/2016 | Xia et al. | |
| 2016/0259084 | A1 | 9/2016 | Xia et al. | |
| 2019/0017377 | A1 | 1/2019 | He et al. | |
| 2019/0078437 | A1 | 3/2019 | Wang et al. | |
| 2019/0100995 | A1 | 4/2019 | He et al. | |
| 2020/0378250 | A1 | 12/2020 | Olapade et al. | |
| 2020/0392843 | A1 | 12/2020 | Golovko et al. | |
| 2020/0400017 | A1 | 12/2020 | Olapade et al. | |
| 2020/0400858 | A1 | 12/2020 | Olapade et al. | |
| 2021/0047924 | A1 | 2/2021 | Kallehbasti et al. | |
| 2021/0054737 | A1 | 2/2021 | Dai et al. | |
| 2023/0054254 | A1 | 2/2023 | Jones et al. | |
| 2023/0054922 | A1 | 2/2023 | Jones et al. | |
| 2023/0058017 | A1 | 2/2023 | Halliburton | |
| 2023/0097490 | A1 | 3/2023 | Chen et al. | |

* cited by examiner

LARGE COUNT MICROSAMPLER

BACKGROUND

Wells may be drilled at various depths to access and produce oil, gas, minerals, and other naturally occurring deposits from subterranean geological formations. The drilling of a well is typically accomplished with a drill bit that is rotated within the well to advance the well by removing topsoil, sand, clay, limestone, calcites, dolomites, or other materials.

During or after drilling operations, sampling operations may be performed to collect a representative sample of formation or reservoir fluids (e.g., hydrocarbons) using a fluid sampling tool. Fluid sampling tools may be disposed on a drill string, in a bottom hole assembly, and/or deployed on a wireline. The representative sample of formation or reservoir fluid (i.e., a fluid sample) may be taken to the surface after drilling and/or logging operations. Analyses of the fluid samples may be utilized to evaluate drilling operations and production potential, or to detect the presence of certain gases or other materials in the formation that may affect well performance.

Generally, fluid sampling tools are limited in the number of fluid samples that may be taken during sampling operations. Microsamplers may be utilized to save space and may allow for a large number of fluid samples to be taken. However, each microsampler adds complexity and space to the microsampling system. This may create complex mechanical and fluid system in order to take a large number of fluid samples.

BRIEF DESCRIPTION OF THE DRAWINGS

The features and advantages of certain embodiments will be more readily appreciated when considered in conjunction with the accompanying figures. The figures are not to be construed as limiting any of the preferred embodiments.

DETAILED DESCRIPTION

The present disclosure relates to methods and systems for a microsampler. Specifically, actuation mechanisms for acquiring a large number of microsamples in a confined amount of space. As discussed below, the methods and systems of the mechanisms described below simplify the mechanical and fluid systems needed to acquire a large number of fluid samples during a downhole sampling operation and subsequently analyze those microsamples once the microsampler has been removed to the surface.

Figure 1:
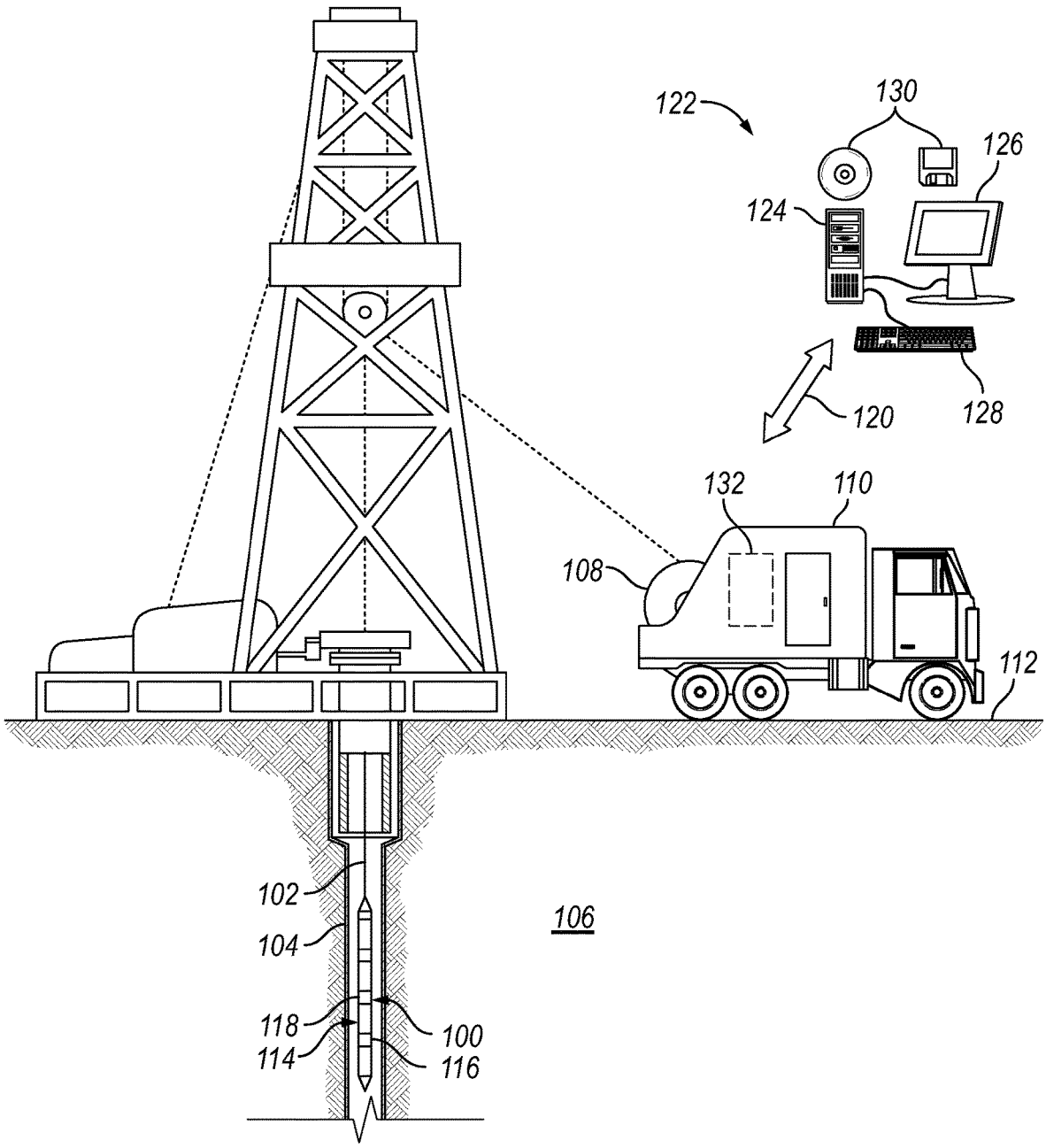
FIG. 1 illustrates a schematic view of a well in which an example embodiment of a fluid sample system is deployed.

FIG. 1 is a schematic diagram of fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Fluid sampling tool 100 may be suspended in wellbore 104 on conveyance 102. Other conveyance types may be used for conveying fluid sampling tool 100 into wellbore 104, including coiled tubing, drill pipe, and wired drill pipe, for example. Fluid sampling tool 100 may comprise a tool body 114, which may be elongated as shown on FIG. 1. Tool body 114 may be any suitable material, including without limitation titanium, stainless steel, alloys, plastic, combinations thereof, and the like. Fluid sampling tool 100 may further comprise one or more sensors 116 for measuring properties of the fluid sample, reservoir fluid, wellbore 104, subterranean formation 106, or the like. In examples, fluid sampling tool 100 may also comprise a fluid analysis module 118, which may be operable to process information regarding fluid sample, as described below. The fluid sampling tool 100 may be used to collect fluid samples from subterranean formation 106 and may obtain and separately store different fluid samples from subterranean formation 106.

In examples, fluid analysis module 118 may comprise at least one sensor that may continuously monitor a fluid such as a reservoir fluid, formation fluid, wellbore fluid, or formation nonnative fluids such as drilling fluid filtrate. Such monitoring may take place in a fluid flow line or a formation tester probe such as a pad or packer or may be able to make measurements investigating the formation including measurements into the formation. Such sensors comprise optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, pressure sensors, nuclear magnetic resonance (NMR) sensors. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped component concentrations, as described above. The fluid analysis module 118 may also measure gas-to-oil ratio, fluid composition, water cut, live fluid density, live fluid viscosity, formation pressure, and formation temperature and fluid composition. Fluid analysis module 118 may also be operable to determine fluid contamination of the fluid sample and may comprise any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. The absorption, transmittance, or reflectance spectra absorption, transmittance, or reflectance spectra may be measured with sensors 116 by way of standard operations. For example, fluid analysis module 118 may comprise random access memory (RAM), one or more processing units, such as a central processing unit (CPU), or hardware or software control logic, ROM, and/or other types of nonvolatile memory. Fluid analysis module 118 and fluid sampling tool 100 may be communicatively coupled via communication link 120 with information handling system 122.

Any suitable technique may be used for transmitting signals from the fluid sampling tool 100 to the surface 112. As illustrated, a communication link 120 (which may be wired or wireless, for example) may be provided that may transmit data from fluid sampling tool 100 to an information handling system 122 at surface 112. Information handling system 122 may comprise a processing unit 124, a monitor 126, an input device 128 (e.g., keyboard, mouse, etc.), and/or computer media 130 (e.g., optical disks, magnetic disks) that can store code representative of the methods described herein. Information handling system 122 may act as a data acquisition system and possibly a data processing system that analyzes information from fluid sampling tool 100. For example, information handling system 122 may process the information from fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
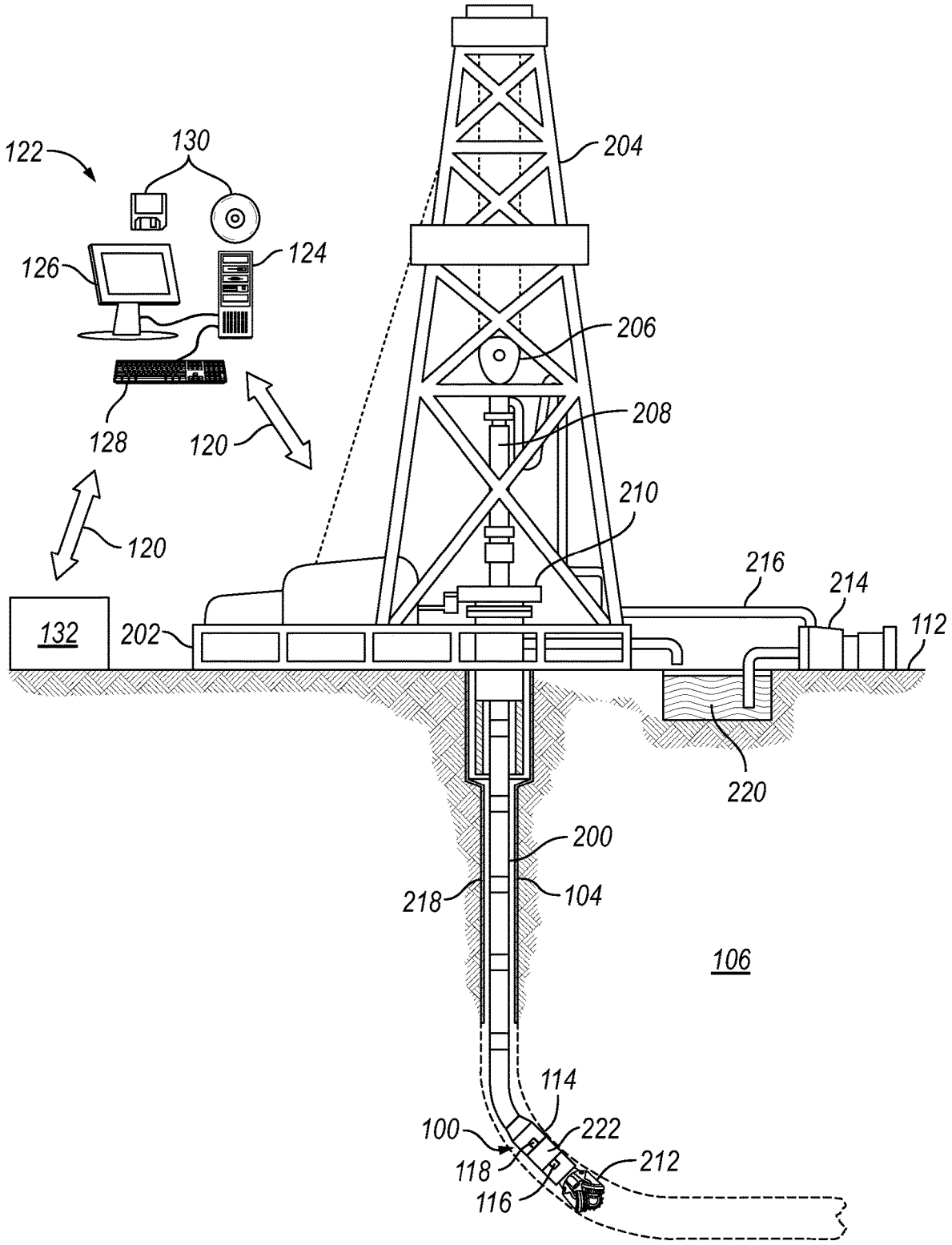
FIG. 2 illustrates a schematic view of another well in which an example embodiment of a fluid sample system is deployed.

Referring now to FIG. 2, a schematic diagram of fluid sampling tool 100 disposed on a drill string 200 in a drilling operation. Fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may comprise, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may comprise, roller cone bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may comprise one or more drill collars 222 and fluid sampling tool 100. Fluid sampling tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Fluid sampling tool 100 may be similar in configuration and operation to fluid sampling tool 100 shown on FIG. 1 except that FIG. 2 shows fluid sampling tool 100 disposed on drill string 200. Alternatively, the sampling tool may be lowered into the wellbore after drilling operations on a wireline.

Fluid sampling tool 100 may further comprise one or more sensors 116 for measuring properties of the fluid sample reservoir fluid, wellbore 104, subterranean formation 106, or the like. The one or more sensors 116 may be disposed within fluid analysis module 118. In examples, more than one fluid analysis module may be disposed on drill string 200. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The fluid sampling tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low also depends on the nature of the formation fluid such that lower contamination may be generally needed, the lighter the oil as designated with either a higher GOR or a higher API gravity. Sufficiently low also depends on the mechanism of property deconvolution from the effects of contamination. For instance, a single sample estimate of contamination may only allow a first order mitigation of the effects of contamination on reservoir fluid property estimation whereas multiple samples with varying degrees of contamination may allow contamination to be more effectively deconvoluted with more samples of greater variation a high accuracy contamination estimation or various combinations therein being better. Sufficiently low also depends on the rate of cleanup in a cost benefit analysis since longer pumpout times to incrementally reduce the contamination levels may have prohibitively large costs, and because samples are limited in number and multiple bulk samples across a single pumpout may be a costly way to estimate contamination. As previously described, the fluid sample may comprise a reservoir fluid, which may be contaminated with a drilling fluid or drilling fluid filtrate. Fluid sampling tool 100 may obtain and separately store different fluid samples from subterranean formation 106 with fluid analysis module 118. Fluid analysis module 118 may operate and function in the same manner as described above. However, storing of the fluid samples in the fluid sampling tool 100 may be based on the determination of the fluid contamination. For example, if the fluid contamination exceeds a tolerance, then the fluid sample may not be stored. If the fluid contamination is within a tolerance, then the fluid sample may be stored in the fluid sampling tool 100. In examples, contamination may be defined within fluid analysis module 118.

As previously described, information from fluid sampling tool 100 may be transmitted to an information handling system 122, which may be located at surface 112. As illustrated, communication link 120 (which may be wired or wireless, for example) may be provided that may transmit data from fluid sampling tool 100 to an information handling system 122 at surface 112. Information handling system 122 may comprise a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate asphaltenes within a fluid sample.

Figure 3:
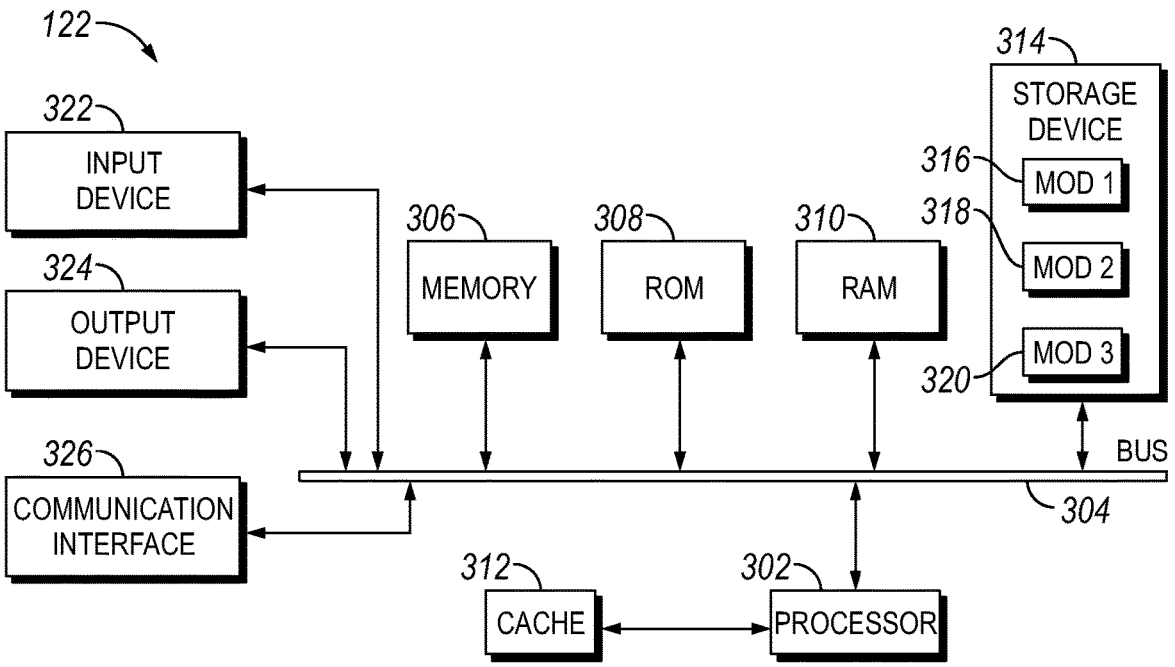
FIG. 3 illustrates a schematic view of a chipset in an information handling system.

FIG. 3 illustrates an example information handling system 122 which may be employed to perform various steps, methods, and techniques disclosed herein. Persons of ordinary skill in the art will readily appreciate that other system examples are possible. As illustrated, information handling system 122 comprises a processing unit (CPU or processor) 302 and a system bus 304 that couples various system components including system memory 306 such as read only memory (ROM) 308 and random-access memory (RAM) 310 to processor 302. Processors disclosed herein may all be forms of this processor 302. Information handling system 122 may comprise a cache 312 of high-speed memory connected directly with, in close proximity to, or integrated as part of processor 302. Information handling system 122 copies data from memory 306 and/or storage device 314 to cache 312 for quick access by processor 302. In this way, cache 312 provides a performance boost that avoids processor 302 delays while waiting for data. These and other modules may control or be configured to control processor 302 to perform various operations or actions. Other system memory 306 may be available for use as well. Memory 306 may comprise multiple different types of memory with different performance characteristics. It may be appreciated that the disclosure may operate on information handling system 122 with more than one processor 302 or on a group or cluster of computing devices networked together to provide greater processing capability. Processor 302 may comprise any general-purpose processor and a hardware module or software module, such as first module 316, second module 318, and third module 320 stored in storage device 314, configured to control processor 302 as well as a special-purpose processor where software instructions are incorporated into processor 302. Processor 302 may be a self-contained computing system, containing multiple cores or processors, a bus, memory controller, cache, etc. A multi-core processor may be symmetric or asymmetric. Processor 302 may comprise multiple processors, such as a system having multiple, physically separate processors in different sockets, or a system having multiple processor cores on a single physical chip. Similarly, processor 302 may comprise multiple distributed processors located in multiple separate computing devices but working together such as via a communications network. Multiple processors or processor cores may share resources such as memory 306 or cache 312 or may operate using independent resources. Processor 302 may comprise one or more state machines, an application specific integrated circuit (ASIC), or a programmable gate array (PGA) including a field PGA (FPGA).

Each individual component discussed above may be coupled to system bus 304, which may connect each and every individual component to each other. System bus 304 may be any of several types of bus structures including a memory bus or memory controller, a peripheral bus, and a local bus using any of a variety of bus architectures. A basic input/output (BIOS) stored in ROM 308 or the like, may provide the basic routine that helps to transfer information between elements within information handling system 122, such as during start-up. Information handling system 122 further comprises storage devices 314 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 314 may comprise software modules 316, 318, and 320 for controlling processor 302. Information handling system 122 may comprise other hardware or software modules. Storage device 314 is connected to the system bus 304 by a drive interface. The drives and the associated computer-readable storage devices provide non-volatile storage of computer-readable instructions, data structures, program modules and other data for information handling system 122. In one aspect, a hardware module that performs a particular function comprises the software component stored in a tangible computer-readable storage device in connection with the necessary hardware components, such as processor 302, system bus 304, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 122 is a small, handheld computing device, a desktop computer, or a computer server. When processor 302 executes instructions to perform "operations", processor 302 may perform the operations directly and/or facilitate, direct, or cooperate with another device or component to perform the operations.

As illustrated, information handling system 122 employs storage device 314, which may be a hard disk or other types of computer-readable storage devices which may store data that are accessible by a computer, such as magnetic cassettes, flash memory cards, digital versatile disks (DVDs), cartridges, random access memories (RAMs) 310, read only memory (ROM) 308, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 122, an input device 322 represents any number of input mechanisms, such as a microphone for speech, a touch-sensitive screen for gesture or graphical input, keyboard, mouse, motion input, speech and so forth. Additionally, input device 322 may take in data from one or more sensors 136, discussed above. An output device 324 may also be one or more of a number of output mechanisms known to those of skill in the art. In some instances, multimodal systems enable a user to provide multiple types of input to communicate with information handling system 122. Communications interface 326 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 302, that is purpose-built to operate as an equivalent to software executing on a general-purpose processor. For example, the functions of one or more processors presented in FIG. 3 may be provided by a single shared processor or multiple processors. (Use of the term "processor" should not be construed to refer exclusively to hardware capable of executing software.) Illustrative embodiments may comprise microprocessor and/or digital signal processor (DSP) hardware, read-only memory (ROM) 308 for storing software performing the operations described below, and random-access memory (RAM) 310 for storing results. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 122 may practice all or part of the recited methods, may be a part of the recited systems, and/or may operate according to instructions in the recited tangible computer-readable storage devices. Such logical operations may be implemented as modules configured to control processor 302 to perform particular functions according to the programming of software modules 316, 318, and 320.

In examples, one or more parts of the example information handling system 122, up to and including the entire information handling system 122, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may comprise one or more virtual machines, an overlay network, a hypervisor, virtual switching, and any other virtualization application.

Figure 4:
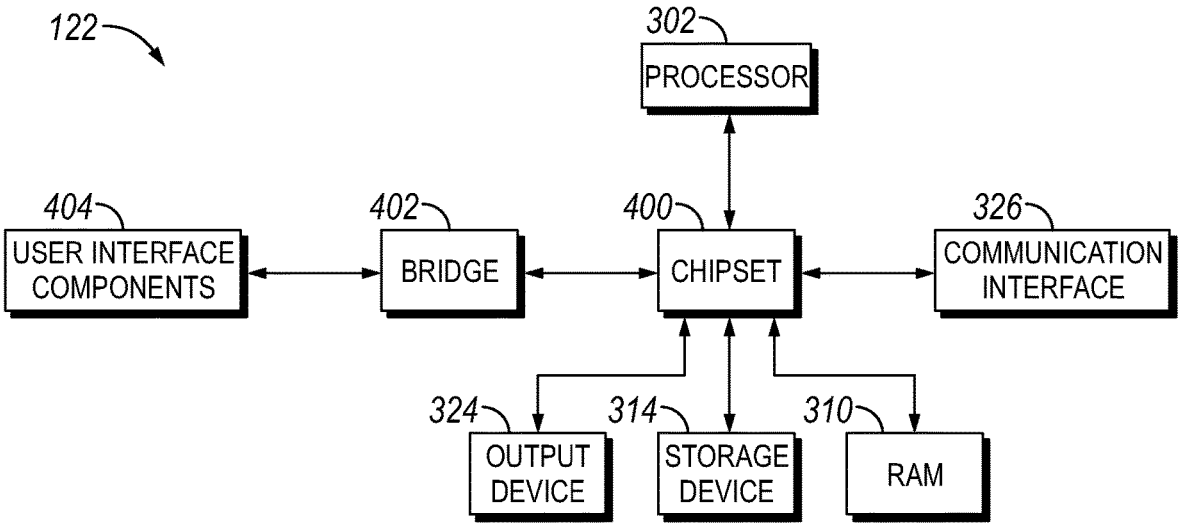
FIG. 4 illustrates the chipset in communication with other components of the information handling system.

FIG. 4 illustrates an example information handling system 122 having a chipset architecture that may be used in executing the described method and generating and displaying a graphical user interface (GUI). Information handling system 122 is an example of computer hardware, software, and firmware that may be used to implement the disclosed technology. Information handling system 122 may comprise a processor 302, representative of any number of physically and/or logically distinct resources capable of executing software, firmware, and hardware configured to perform identified computations. Processor 302 may communicate with a chipset 400 that may control input to and output from processor 302. In this example, chipset 400 outputs information to output device 324, such as a display, and may read and write information to storage device 314, which may comprise, for example, magnetic media, and solid-state media. Chipset 400 may also read data from and write data to RAM 310. A bridge 402 for interfacing with a variety of user interface components 404 may be provided for interfacing with chipset 400. Such user interface components 404 may comprise a keyboard, a microphone, touch detection and processing circuitry, a pointing device, such as a mouse, and so on. In general, inputs to information handling system 122 may come from any of a variety of sources, machine generated and/or human generated.

Chipset 400 may also interface with one or more communication interfaces 326 that may have different physical interfaces. Such communication interfaces may comprise interfaces for wired and wireless local area networks, for broadband wireless networks, as well as personal area networks. Some applications of the methods for generating, displaying, and using the GUI disclosed herein may comprise receiving ordered datasets over the physical interface or be generated by the machine itself by processor 302 analyzing data stored in storage device 314 or RAM 310. Further, information handling system 122 receive inputs from a user via user interface components 404 and execute appropriate functions, such as browsing functions by interpreting these inputs using processor 302.

In examples, information handling system 122 may also comprise tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-read-able devices may comprise RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be comprised within the scope of the computer-readable storage devices.

Computer-executable instructions comprise, for example, instructions and data which cause a general-purpose computer, special purpose computer, or special purpose processing device to perform a certain function or group of functions. Computer-executable instructions also comprise program modules that are executed by computers in stand-alone or network environments. Generally, program modules comprise routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices. During drilling operations, information handling system 122 may process different types of the real time data which may be utilized to create an asphaltene onset pressure map (AOP).

Figure 5:
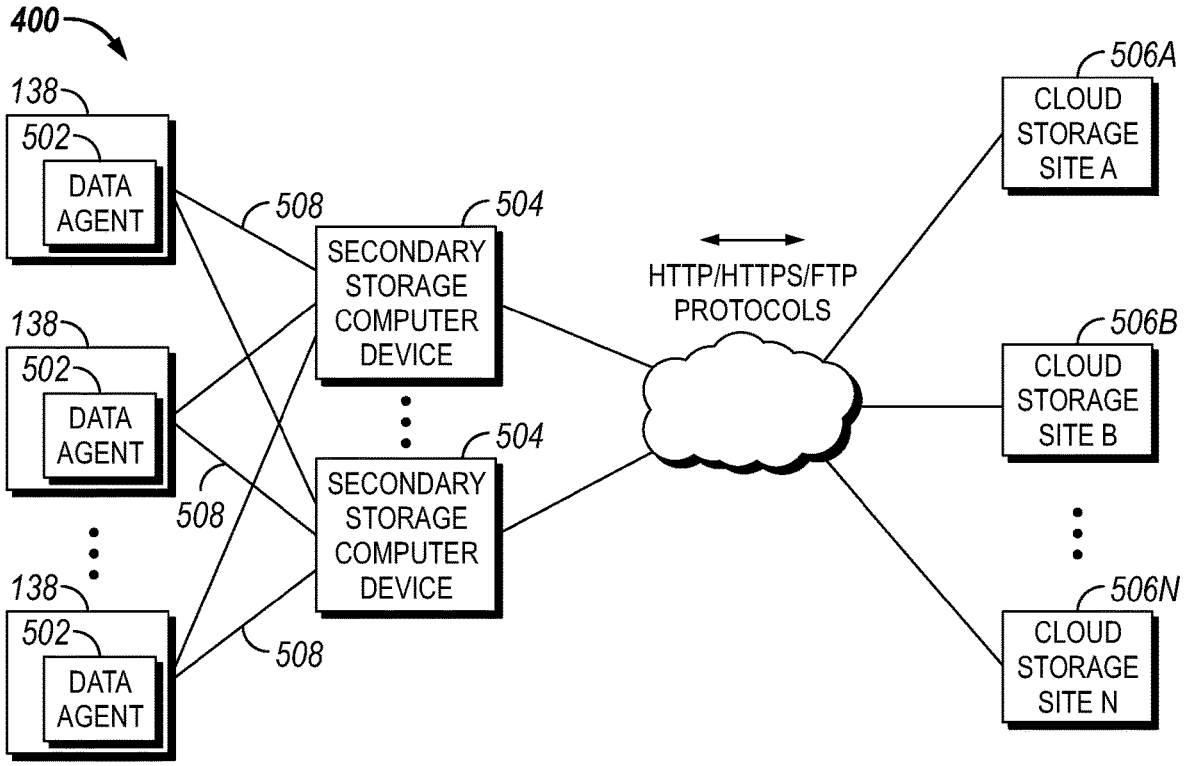
FIG. 5 illustrates a schematic view of a cloud based system.

FIG. 5 illustrates an example of one arrangement of resources in a computing network 500 that may employ the processes and techniques described herein, although many others are of course possible. As noted above, an information handling system 122, as part of their function, may utilize data, which comprises files, directories, metadata (e.g., access control list (ACLS) creation/edit dates associated with the data, etc.), and other data objects. The data on the information handling system 122 is typically a primary copy (e.g., a production copy). During a copy, backup, archive or other storage operation, information handling system 122 may send a copy of some data objects (or some components thereof) to a secondary storage computing device 504 by utilizing one or more data agents 502.

A data agent 502 may be a desktop application, website application, or any software-based application that is run on information handling system 122. As illustrated, information handling system 122 may be disposed at any rig site (e.g., referring to FIG. 1) or repair and manufacturing center. Data agent 502 may communicate with a secondary storage computing device 504 using communication protocol 508 in a wired or wireless system. Communication protocol 508 may function and operate as an input to a website application. In the website application, field data related to pre- and post-operations, generated DTCs, notes, and the like may be uploaded. Additionally, information handling system 122 may utilize communication protocol 508 to access processed measurements, operations with similar DTCs, troubleshooting findings, historical run data, and/or the like. This information is accessed from secondary storage computing device 504 by data agent 502, which is loaded on information handling system 122.

Secondary storage computing device 504 may operate and function to create secondary copies of primary data objects (or some components thereof) in various cloud storage sites 506A-N. Additionally, secondary storage computing device 504 may run determinative algorithms on data uploaded from one or more information handling systems 122, discussed further below. Communications between the secondary storage computing devices 504 and cloud storage sites 506A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 506A-N, the secondary storage computing device 504 may also perform local content indexing and/or local object-level, sub-object-level or block-level deduplication when performing storage operations involving various cloud storage sites 506A-N. Cloud storage sites 506A-N may further record and maintain DTC code logs for each downhole operation or run, map DTC codes, store repair and maintenance data, store operational data, and/or provide outputs from determinative algorithms that are fun at cloud storage sites 506A-N.

Figure 6:
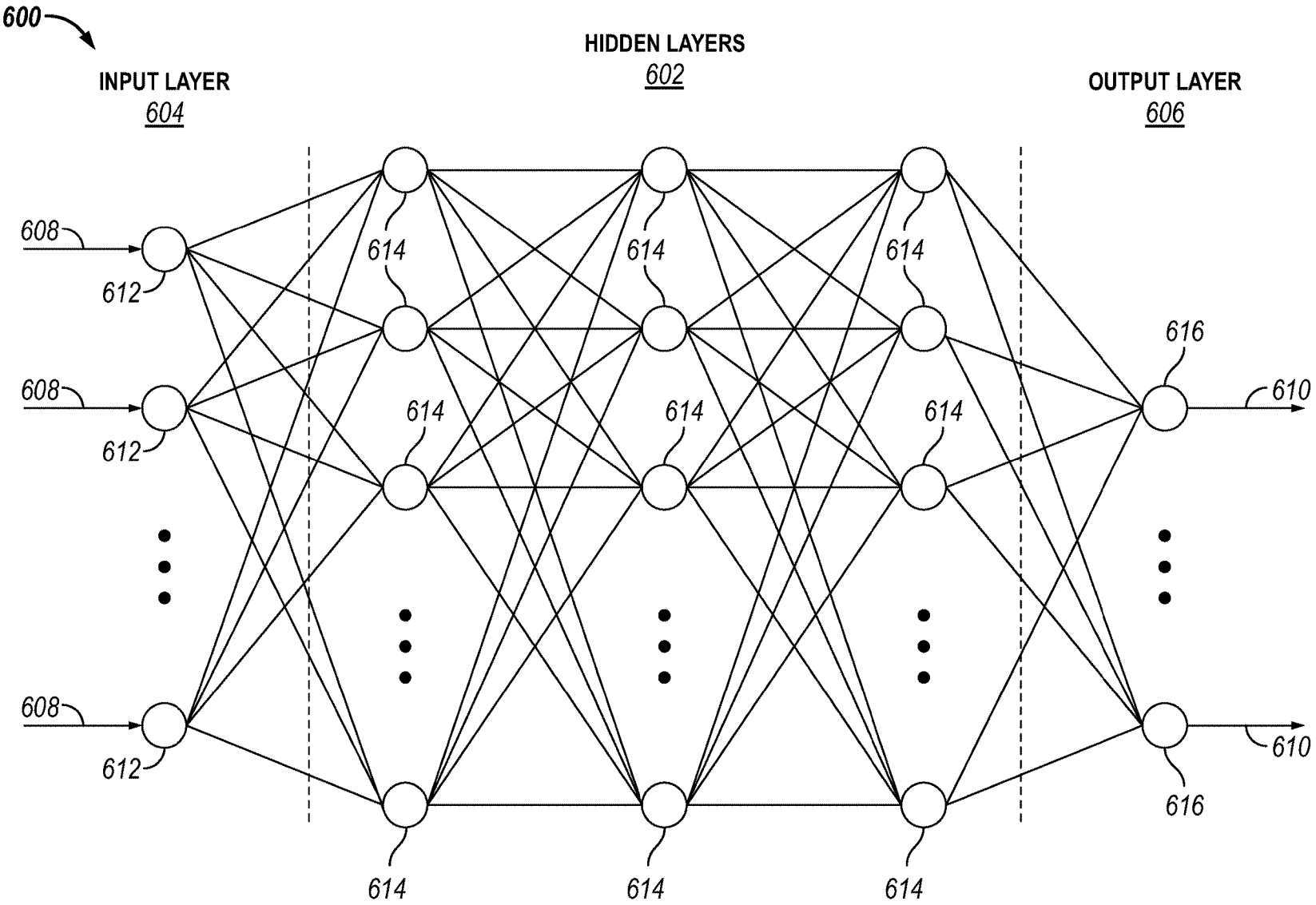
FIG. 6 illustrates a neural network.

FIG. 6 illustrates neural network (NN) 600. NN 600 may operate utilizing one or more information handling systems 122 (e.g., referring to FIGS. 1 and 2) on computing network 500. Although a NN is illustrated, multiple models may be used with input output structures. These models may comprise flexible empirical models such as NN, gaussian processing methods, kriging methods, evolutionary methods such as genetic algorithms, classification methods, clustering methods empirical methods, or physics-based methods such as equations of state, thermodynamic models, geological, geochemistry, or chemistry models, or kinetic models or any combinations therein including recursive combinations of similar or dissimilar models and iterative model combinations. A NN 600 is an artificial neural network with one or more hidden layers 602 between input layer 604 and output layer 606. In examples, NN 600 may be software on a single information handling system 122. In other examples, NN 600 may software running on multiple information handling systems 122 connected wirelessly and/or by a hard-wired connection in a network of multiple information handling systems 122.

During operations, inputs 608 data are given to neurons 612 in input layer 604. Neurons 612, 614, and 616 are defined as individual or multiple information handling systems 122 connected in a network, which may compute information to make drilling, completion or production decisions such as but not limited how to drill the well, where to drill the well, how to complete a well, or where to complete a well, or how to produce a well, or where to produce a well. Any of computations may be from the current well being evaluated or analogue wells which may be in the field, in the basis, or not so if other characteristics such as but not limited to formation type or formation fluid provide a basis for analogy. The output from neurons 612 may be transferred to one or more neurons 614 within one or more hidden layers 602. Hidden layers 602 comprises one or more neurons 614 connected in a network that further process information from neurons 612. The number of hidden layers 602 and neurons 612 in hidden layer 602 may be determined by personnel that designs NN 600. Hidden layers 602 is defined as a set of information handling system 122 assigned to specific processing. Hidden layers 602 spread computation to neurons 614, which may allow for faster computing, processing, training, and learning by NN 600.

Figure 7:
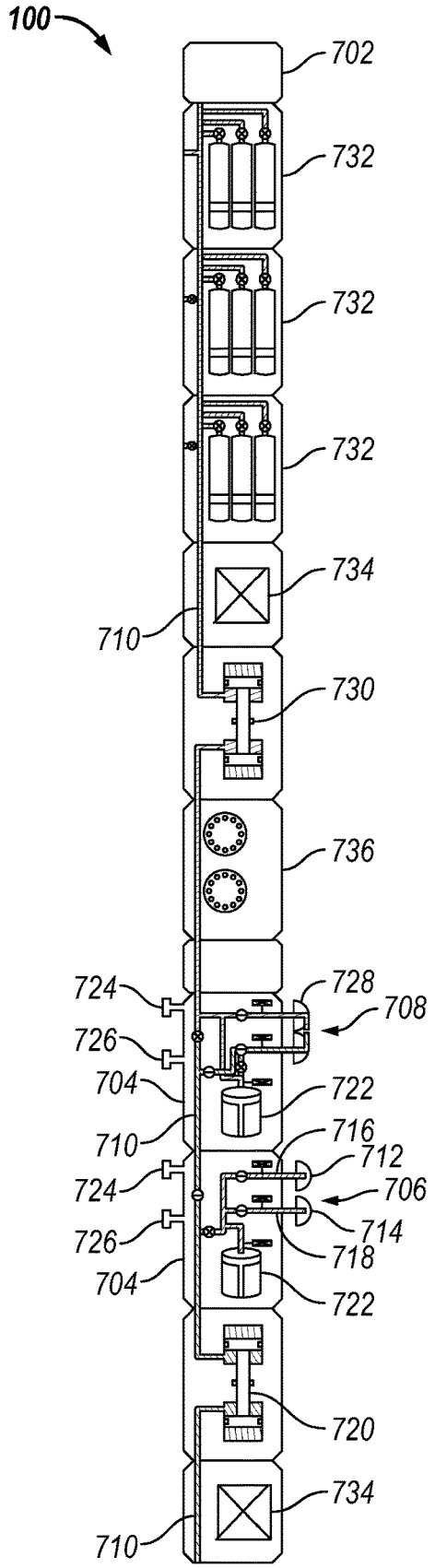
FIG. 7 illustrates a schematic view of an example embodiment of a fluid sampling tool.

FIG. 7 illustrates a schematic of fluid sampling tool 100. As illustrated, fluid sampling tool 100 comprises a power telemetry section 702 through which fluid sampling tool 100 may communicate with other actuators and sensors in a conveyance (e.g., conveyance 102 on FIG. 1 or drill string 200 on FIG. 2), the conveyance's communications system, such as information handling system 122 (e.g., referring to FIG. 1). In examples, power telemetry section 702 may also be a port through which the various actuators (e.g., valves) and sensors (e.g., temperature and pressure sensors) in fluid sampling tool 100 may be controlled and monitored. In examples, power telemetry section 702 may comprise an additional information handling system 122 (not illustrated) that exercises the control and monitoring function. In one example, the control and monitoring function is performed by an information handling system 122 in another part of the drill string or fluid sampling tool 100 (not shown) or by an information handling system at surface 112. The NN or appropriate model may be used to derive system information including state information regarding the fluid such as but not limited to physical and chemical properties described above, or may be used to derive control information for the operation of the downhole device, or may be used to provide information necessary to make a drilling or completion decision regarding the well, or may be used to prioritize sample analysis information regarding bulk or microsamples or combinations therein.

Information from fluid sampling tool 100 may be gathered and/or processed by the information handling system 122 (e.g., referring to FIGS. 1 and 2). The processing may be performed real-time during data acquisition or after recovery of fluid sampling tool 100. Processing may alternatively occur downhole or may occur both downhole and at surface 112. In some examples, signals recorded by fluid sampling tool 100 may be conducted to information handling system by way of conveyance. Information handling system may process the signals, and the information contained therein may be displayed for an operator to observe and stored for future processing and reference. Information handling system may also contain an apparatus for supplying control signals and power to fluid sampling tool 100.

In examples, fluid sampling tool 100 may comprise one or more enhanced probe sections 704 and stabilizers 724. A probe may be a pad of multiple designs or packer of multiple designs or combinations therein. Each enhanced probe section may comprise a dual probe section 706 or a focus sampling probe section 708. Both of which may extract fluid from the reservoir and deliver said fluid to a channel 710 that extends from one end of fluid sampling tool 100 to the other. Without limitation, dual probe section 706 comprises two probes 712, 714 which may extend from fluid sampling tool 100 and press against the inner wall of wellbore 104 (e.g., referring to FIG. 1). Probe channels 716 and 718 may connect probe 712, 714 to channel 710 and allow for continuous fluid flow from the formation 106 to channel 710. A high-volume bidirectional pump 720 may be used to pump fluids from the formation, through probe channels 716, 718 and to channel 710. Alternatively, a low volume pump bi direction piston 722 may be used to remove reservoir fluid from the reservoir and house them for asphaltene measurements, discussed below. Two standoffs or stabilizers 724, 726 hold fluid sampling tool 100 in place as probes 712, 714 press against the wall of wellbore 104. In examples, probes 712, 714 and stabilizers 724, 726 may be retracted when fluid sampling tool 100 may be in motion and probes 712, 714 and stabilizers 724, 726 may be extended to sample the formation fluids at any suitable location in wellbore 104. As illustrated, probes 712, 714 may be replaced, or used in conjunction with, focus sampling probe section 708. Focus sampling prob section 708 may operate and function as discussed above for probes 712, 714 but with a single probe 728. Other probe examples may comprise, but are not limited to, packers, oval probes, or circumferential probes.

In examples, channel 710 may connect other parts and sections of fluid sampling tool 100 to each other. Additionally, fluid sampling tool 100 may comprise a second high-volume bidirectional pump 730 for pumping fluid through channel 710 to one or more multi-chamber sections 732, one or more microsampling device 734, and/or one or more fluid analysis modules 736. Multiple multichambered sampling sections may be disposed within and may form fluid sampling tool 100.

Figure 8:
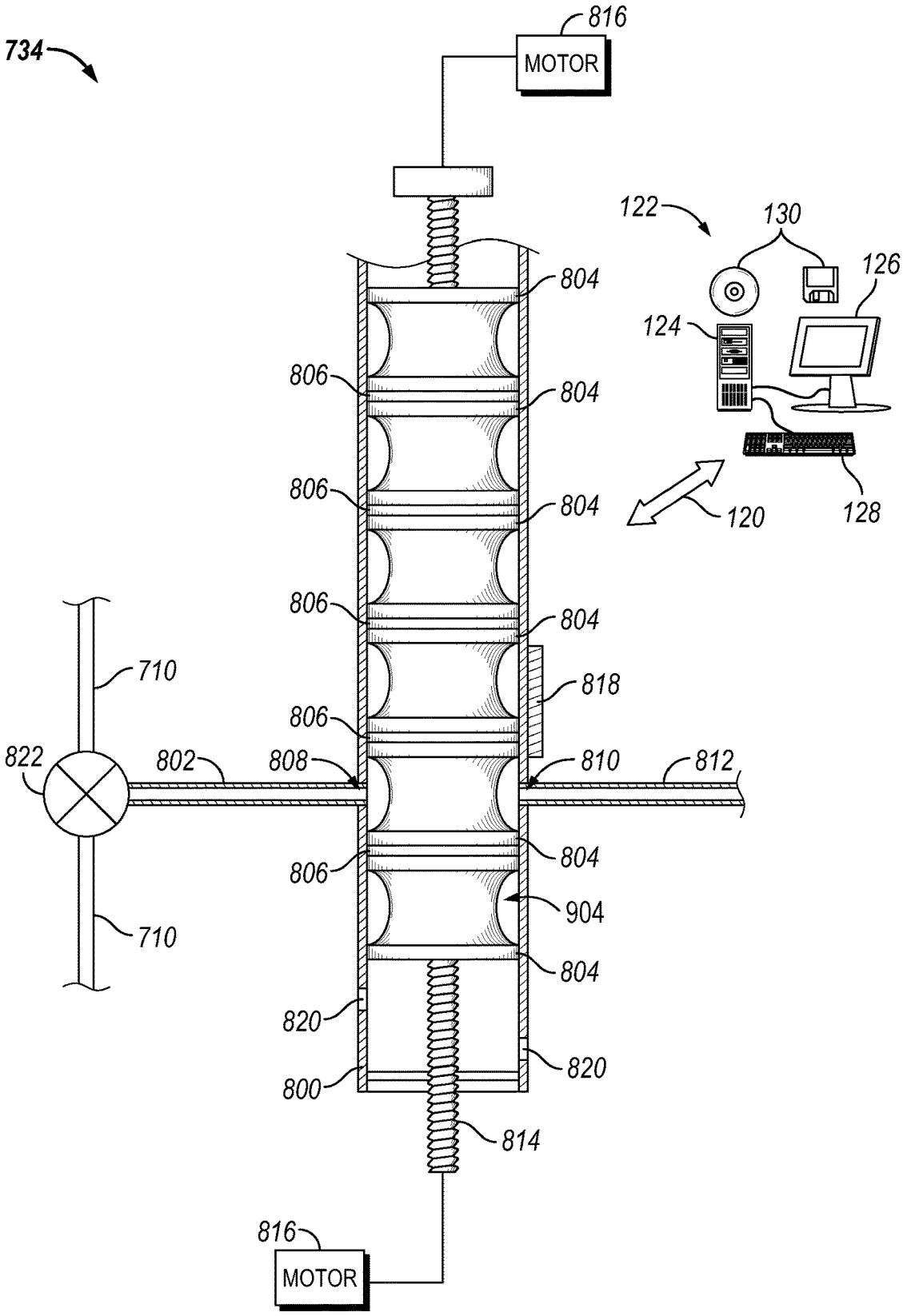
FIG. 8 illustrates an enlarged schematic view of a microsampling device.

FIG. 8 illustrates an expanded view of microsampling device 734. Microsampling device 734 may comprise at least one microsampling tube 800 that may be fluidly connected to channel 710 (e.g., referring to FIG. 7) through inlet valve 822 and fluid flow line 802. Microsampling tube 800 may be of multiple shapes including oval conical, partial conical, rounded star, have sharp edges, or rounded edges. In some embodiments the shape of microsampling tube 800 may be undulating specifically near the fluid entrance port (i.e., inlet 808 discussed below) to microsampling tube 800. Such an undulation may be a feedback marker as to the exact position of microsampler 804. In examples, microsampling tube 800 may be coated with a friction reducing element such as polytetrafluoroethylene, aluminum oxide, or lubricant such as a non-interfering lubricant with respect to the fluid analysis or combination therein. In examples, microsampling tube 800 may comprise one or more microsamplers 804 that may function to contain fluid samples, which may also be referred to as microsamples for this disclosure. Microsamples are fluid samples of one thousand micro-liters or less that may be retrieved or taken from formation 106 and/or wellbore 104 (e.g., referring to FIG. 1) during measurement operations. A small sample size of one thousand micro-liters or less for the microsample is advantageous in that it may allow for a multitude of fluid samples to be taken that far exceed current technologies current ability to perform. Additionally, microsampler 804 may be free of valves that may anchor the microsample to a particular location. This may allow microsampler 804 to move and trap a fluid sample (e.g., a microsample) as opposed to a valve shutting. The small size also allows a pressure balanced design of an annular space in a solid sampling fixture.

Figure 9:
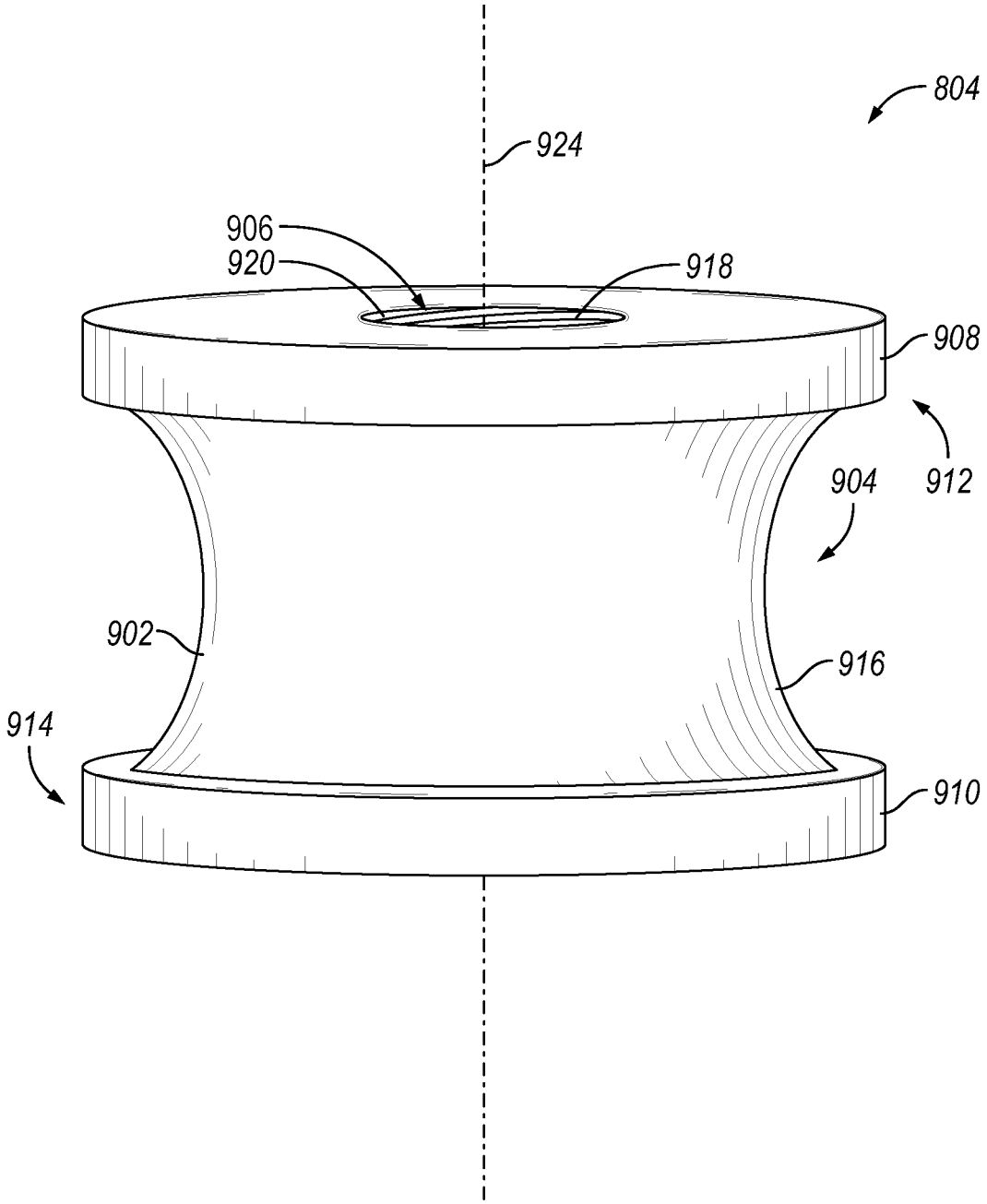
FIG. 9 illustrates a microsampler.

FIG. 9 further illustrates a microsampler 804. As illustrated, microsampler 804 may comprise a plurality of seals that form the top and bottom portions of microsampler 804. As illustrated, the plurality of seals may comprise a top seal 908 and a bottom seal 910 that are secured to opposing ends (e.g., a top end 912 and a bottom end 914) of body 902. Seals 908, 910 may each have a disc shape with a respective outer edge configured to seal against the structural wall of microsampling tube 800 (e.g., referring to FIG. 8). Seals 908, 910 may comprise an elastic material suitable for forming a seal. For example, seals 908, 910 may comprise a silicone rubber material, or any other suitable material. Further, seals 908, 910 may comprise a distinct material from body 902. Alternatively, seals 908, 910 and body 902 may be formed from the same material.

Moreover, body 902 may have a concave cylinder shape. That is, an exterior surface 916 of body 902 between top end 912 and bottom end 914 may be recessed inward about body 902 such that body 902 has a concave cylinder shape. The concave shape may at least partially define a cavity 904 in which a microsample may be stored. Alternatively, exterior surface 916 may comprise other suitable profiles for at least partially defining cavity 904. For example, body 902 may have a substantially cylindrical shape with an annulus recess formed in exterior surface 916, which may at least partially define cavity 904. In another example, cavity 904 may be formed in an interior portion of body 902.

Referring back to FIG. 8, the structural wall of microsampling tube 800 may also partially define cavity 904. In particular, cavity 904 may be defined between the structural wall of microsampling tube 800 and exterior surface 916 of body 902 (e.g., referring to FIG. 9). Alternatively, top seal 908, bottom seal 910, exterior surface 916 of body 902, and structural wall of microsampling tube 800 may define cavity 904, which may form a liquid/pressure tight containment area in which fluid samples may be stored. During measurement operations, fluid samples (e.g., microsamples) may flow into the containment area (e.g., cavity 904) from fluid flow line 802 which is connected to microsampling tube 800 via inlet 808. In particular, fluid may flow through fluid flow line 802, into the containment area of microsampler 804, out of the containment area, via outlet 810, and into a secondary fluid flow line 812. Inlet 808 and outlet 810 may be displaced with respect to each other vertically, horizontally, radially or azimuthally. Inlet 808 and outlet 810 may be of differing cross-sectional areas. Inlet 808 and outlet 810 may be of shapes other than cylindrical. During this operation, fluid flowing through the containment area may fill the containment area. As cavity 904 is filled, fluid may flow through outlet 810 and into secondary fluid flow line 812. Once filled, microsampling device 734 may drive microsampler 804 to move along microsampling tube 800 and away from inlet 808 and outlet 810, which may seal fluid (e.g., the microsample) inside the containment area. That is, with microsampler 804 offset from inlet 808 and outlet 810, the fluid containment area may be sealed by top seal 908, bottom seal 910, exterior surface 916 of body 902, and/or structural wall of microsampling tube 800 to hold the microsample. This particular method of containment is particularly convenient as it allows multiple microsamples in a small area.

As noted above, there may be a plurality of microsamplers 804 disposed within microsampling tube 800. Each microsampler 804 may be separated by a spacer 806. In examples, spacer 806 may have a volume to capture a fluid sample should a microsampler 804 leak. For examples, spacer 806 may from a liquid/pressure tight seal. Further, spacer 806 may be made of a material that may absorb a fluid that may leak out of a microsampler 804, which may prevent contamination between each microsampler 804. As illustrated, microsamplers 804 and spacers 806 may be connected to each other. In examples, microsampler 804 may attach to spacer 806 through, a press fitting, nuts and bold, hooks and loops, glue, and/or the like. Like microsampler 804, spacer 806 may be threaded, which may allow for spacer 806 to rotate with and/or connect to microsampler 804 via a threaded rod 814.

Referring to FIG. 9, each microsampler 804 may have a threaded corridor 906 extending through a central axis, which is the longitudinal axis, of body 902 of the respective microsampler 804. Threaded corridor 906 may comprise internal threads 918 formed along an inner surface 920 of microsampler 804 (e.g., body 902, top seal 908, and bottom seal 910). In examples, inner surface 920 may also be defined as a central bore extending through a central axis 924 of the respective microsampler 804. As shown in FIG. 8, threaded rod 814 may interface with microsampler 804 via threaded corridor 906. In particular, threaded rod 814 may comprise external threads configured to interface with internal threads 918 of threaded corridor 906 such that threaded rod 814 may be threaded into and through threaded corridor 906. During measurement operations, threaded rod 814 may be secured to motor 816 that is configured to rotate threaded rod 814. Due to the threaded interface between threaded corridor 906 and threaded rod 814, rotation of threaded rod 814 may drive axial movement of microsampler 804 with respect to threaded rod 814. For example, rotation of threaded rod 814 may cause microsampler 804 to move axially downward/upward, with respect to threaded rod 814, along microsampling tube 800 to move microsampler 804 from a position in fluid communication with inlet 808 and outlet 810 to a position axially offset from inlet 808 and outlet 810.

Additionally, seals 908, 910 may apply enough force to microsampling tube 800 to maintain a seal between seals 908, 910 and an inner surface of the structural wall of microsampling tube 800 as microsampler 804 moves along or through microsampling tube 800. Seals 908, 910 may comprise one or more polymeric O-rings (not shown) that may be compressed with and/or by microsampler 804 positioned in the microsampling tube 800 such that elastic forces of the O-rings apply sufficient force to maintain the seal. Alternatively, or in combination, the polymeric O-ring may swell in contact with oil or water and create a leak-free seal 900. Further, the polymeric O-ring may be oleophilic or oleophobic. The polymeric O-ring may be hydrophobic or hydrophilic. Utilizing a plurality of polymeric O-rings, a "sandwich" of polymeric O-rings may be used to increase the seal between microsamplers 804, wherein an oleophobic polymeric O-ring is in between two oleophilic polymeric O-rings to seal a fluid sample, such as oil, in cavity 904 within microsampler 804. In another example, a hydrophobic polymeric O-ring is in between two hydrophilic polymeric O-rings to seal a fluid sample, such as brine, in cavity 904 within microsampler 804. It should be noted that any number of stacking or "sandwiching" between different polymeric O-rings may be created. Referring back to FIG. 8, one or more motors 816 may be connected to threaded rod 814. As set forth above, each motor 816 may work separately or together to rotate threaded rod 814. This may allow for the movement of a plurality of microsamplers 804 and a plurality of spacer 806 to move along microsampling tube 800. This may allow for multiple fluid samples to be taken, as each microsampler 804 may be utilized to contain a single fluid sample.

Figure 10:
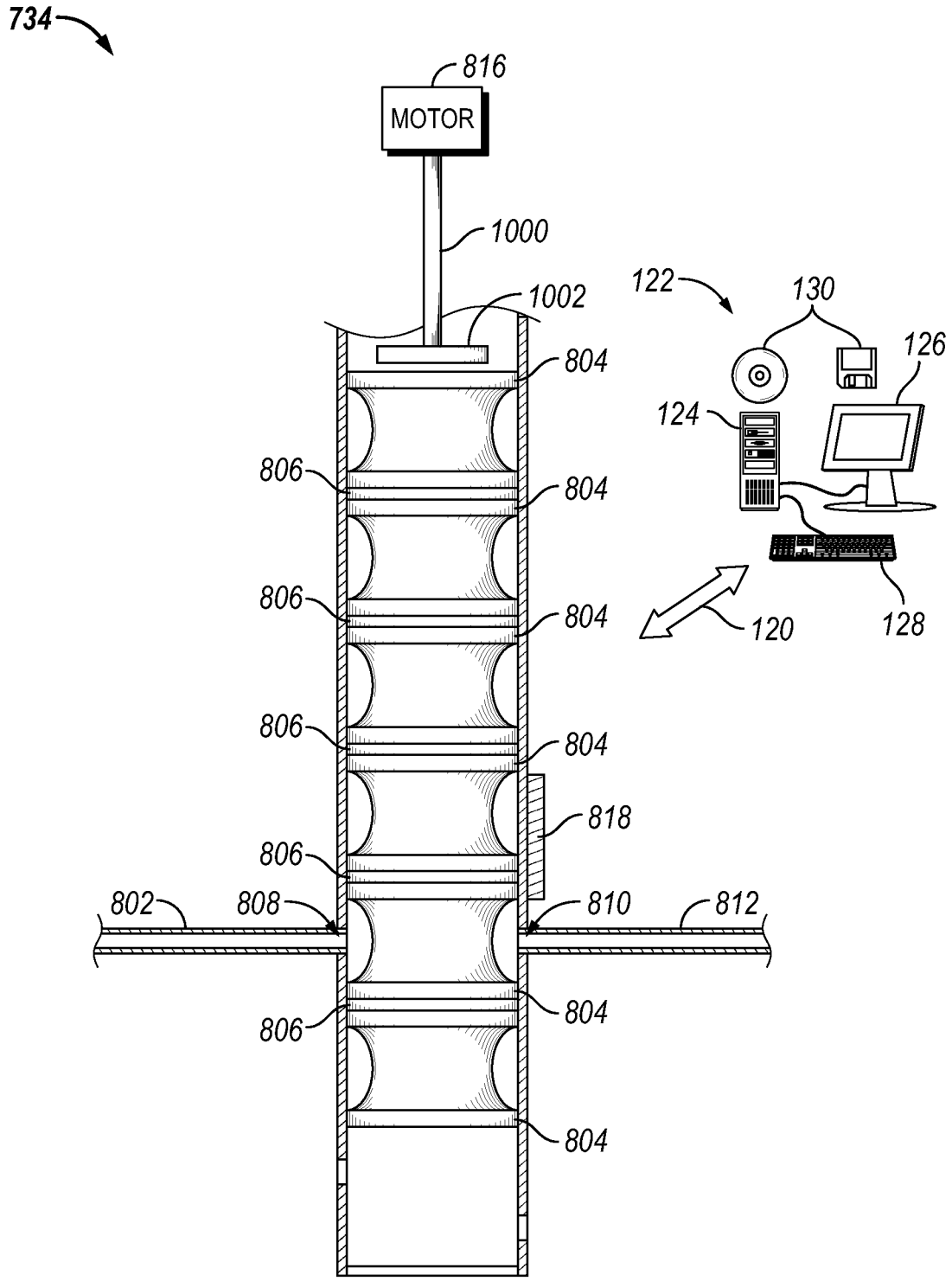
FIG. 10 illustrates a motor connected to a plunger.

In FIG. 10, a single motor 816 may be connected to a rod 1000 that is connected to a plunger 1002. Motor 816 may actuate rod 1000, which may drive plunger 1002 to move through the microsampling tube 800. Plunger 1002 may contact a microsampler 804 or a spacer 806, such that movement of plunger 1002 may exert a force upon a microsampler 804 or spacer 806, which may exert force on all abutting spacers 806 and microsamplers 804. This may push each microsampler 804 and/or spacer 806 through microsampling tube 800, thus, allowing each microsampler 804 to obtain a fluid sample during operations. Microsampler 804 may interconnect with each other or spacers 806 and in combinations therein (i.e., multiple microsamplers and multiple spacers). This may allow better control in positioning a microsampler 804 and provide safety, preventing a single compromised microsample from exerting a net projectile force. In other examples, one or more microsamplers 804 may be pulled or pushed through microsampling tube 800. Microsampler 804 may be pushed or pulled by plunger 1002, screw rod, or wire according to some embodiments. Microsampler 804 may be bi-directional. Other mechanisms that may drive microsampler 804 throughout microsampling tube 800 comprise pneumatic and hydraulic drives. For instance, a pneumatic drive may be achieved by storing compressed gas in one or more sampling bottles or another type of gas reservoir and/or by producing compressed gas using bidirectional pump 720 for instance. In other examples, hydraulic pressure may be self-advanced by the action of a pressure differential between the sample pressure and the wellbore pressure. Hydraulic pressure may also be produced intentionally for the purpose of advancing a sample. The hydraulic or pneumatic force may also be generated against a receptacle chamber in order to produce the pressure differential.

Figure 11:
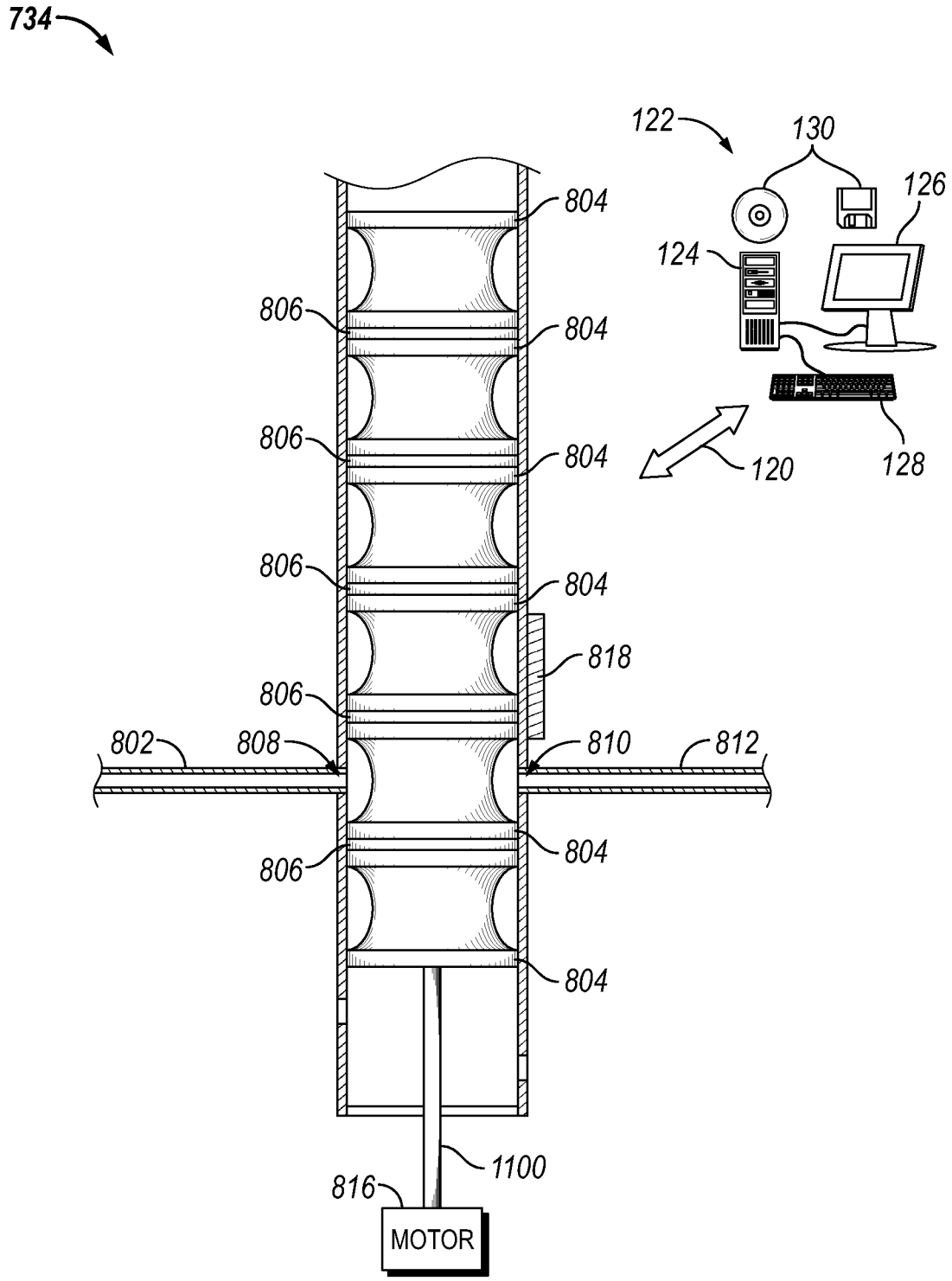
FIG. 11 illustrates a motor connected to a wire.

FIG. 11 illustrates another example in which a single motor 816 may connect to a microsampler 804 with a metal wire 1100. In this example, motor 816 may draw in metal wire 1100 to move microsampler 804 through microsampling tube 800. That is, a distal end of metal wire 1100 may be attached to microsampler 804 such that the microsampler is pulled toward motor 816 as metal wire 1100 is drawn in or retracted by motor 816. Pulling microsampler 804 toward motor 816 may move microsampler 804 through microsampling tube 800. As discussed above, all spacers 806 and microsamplers 804 may be connected together. Thus, as one microsampler 804 is pulled, all microsamplers 804 and spacers 806 may also be pulled. As such, each microsampler 804 may be pulled through microsampling tube 800, thus, allowing each microsampler 804 to obtain a fluid sample during operations.

Referring back to FIG. 8, movement of microsamplers 804 and/or spacers 806 may be tracked using a sensor 818 that may be attached to microsampling tube 800. Sensor 818 may be a magnet, an electromagnet, acoustic, capacitance measurement and/or the like at one or multiple positions within microsamplers 804 or spacers 806 and at one or multiple locations along the interior or exterior of microsampling tube 800. The position may also be tracked by undulations, notches, or altered positions within microsampling tube 800 by monitoring resistance of microsamplers 804 to movement. The position may also be tracked by a motor 816 that tracks turn position such as a stepper motor, or a motor 816 fitted with a resolver or by monitoring the Hall effect of motor 816 or by similar means. In examples, spacers 806 and/or microsamplers 804 may be a material that interacts with sensor 818 magnetically and/or otherwise. Sensor 818 may communicate with information handling system 122, which may determine the location of microsamplers 804 within microsampling tube 800 using sensor 818. Using measurements from sensor 818, information handling system 122 (e.g., referring to FIG. 8) may control sampling operations through communication link 120, which may at least in part, control motor 816. In other examples, a control sequence that activates motor 816 may be performed through wireless means, such as a generating and sensing pressure pulses.

Figure 12:
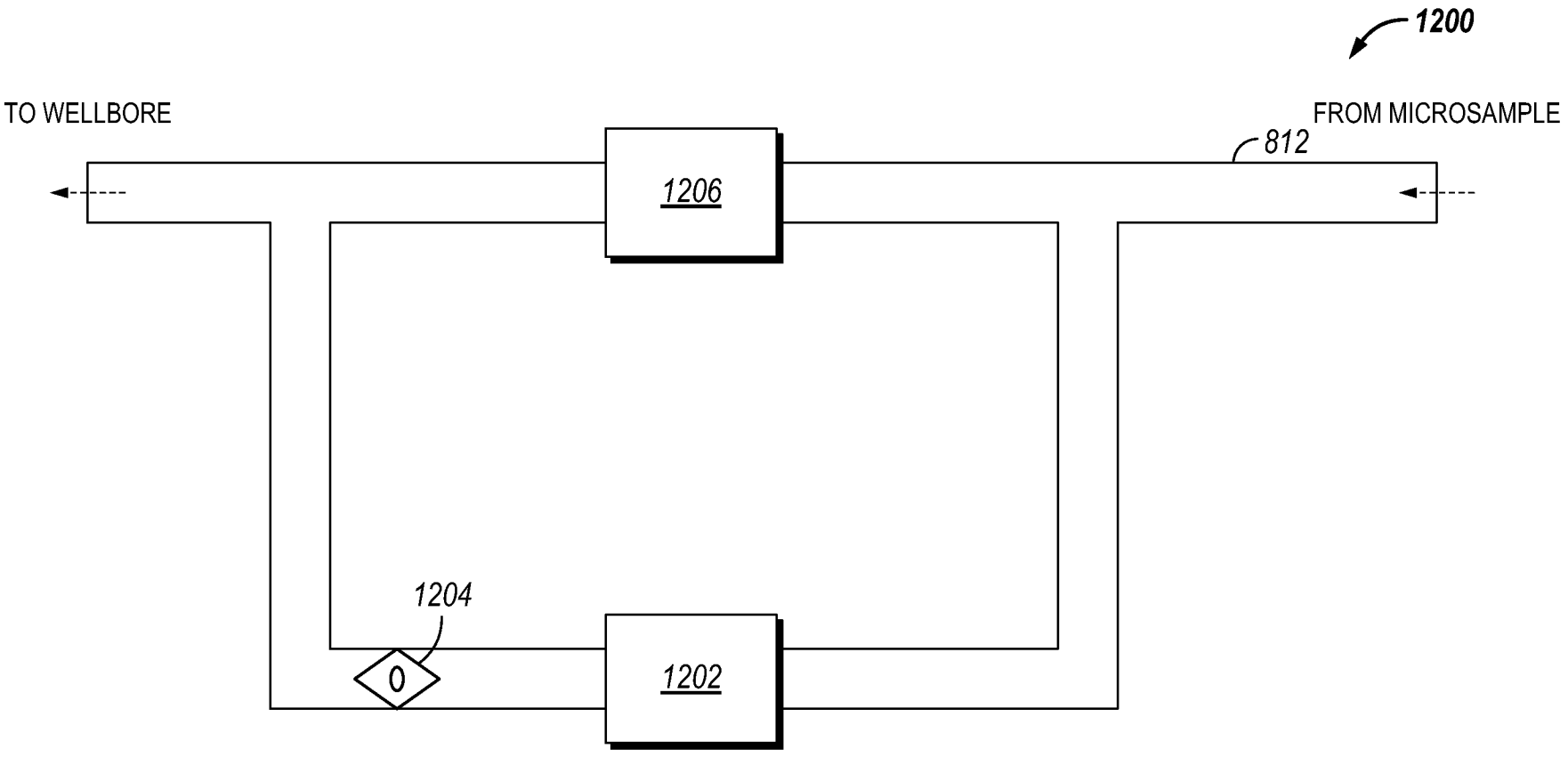
FIG. 12 illustrates a valve system to form a pressure pulse.

FIG. 12 illustrates a valve system 1200 that may be utilized to generate a pressure pulse in fluid flow line 802. In this example, motor 816 may not be a stepper motor, which would not be advantageous if control feedback for positioning, utilizing communication link 120 and information handling system 122 (e.g., referring to FIG. 8), is used. To generate a reliable pressure pulse that may be used as a signal, inlet valve 822 that is connected to channel 710 (e.g., referring to FIG. 8) may be opened. Inlet valve 822 may work in conjunction with valve system 1200 to generate a pressure pulse. As illustrated in FIG. 12, valve system 1200 is connected to secondary fluid flow line 812. Valve system 1200 functions and operates as a flow restriction that does not let fluid pass at normal flow rates. In example, valve system 1200 comprises a first check valve 1202 that opens as soon as fluid flow begins during a sampling operation. However, fluid flow is restricted by flow restrictor 1204 so the pressure continues to build up until second check valve 1206 opens, creating a pressure pulse. This pressure pulse is measured by one or more pressure gauges disposed upstream and/or downstream of second check valve 1206. In examples, first check valve 1202 may have an operating range of five psi to fifteen psi. Additionally, second check valve 1206 may have an operating range of two hundred and fifty psi to one thousand psi. In any case, first check valve 1202 must have an operating range or psi that is lower than second check valve 1206 operating range or psi. Upon sensing a pressure pulse by one or more pressure gauges, motor 816 may automatically move to a new microsampler 804, completing a sampling operation. In examples, microsampling device 734 may move a new microsample 804 into position, may wait for a period of time such as two minutes, and may move microsample 804 out of position. Actual times may be fixed to different interfiles or variable depending on conditions and/or parameters. For instance, a more viscous fluid may utilize more time or a less viscous fluid may be sampled quicker. After sampling the pressure bleads off through flow restrictor 1204 until the next pressure pulse is generated. The sampling sequence then resets at the operating range or point of first check valve 1202.

After sampling operations, microsampling tube 800 may be sealed. For example, the topmost and or bottom most microsamplers 804 (e.g., referring to FIG. 8) may function and operate as plugs. Additionally, plug type devices (not illustrated) may be attached to the topmost and bottom most microsamplers 804. This may allow for microsampling tube 800 to be locked and sealed once all microsamplers 804 have acquired a fluid sample. Once locked, fluid samples may be retrieved from microsamplers 804 through capillary ports 820 at surface once fluid sampling tool 100 has been removed from wellbore 104. Pressure may be used to force sampled downhole fluid out of microsampler 804 through capillary port 820. In examples, capillary port 820 may have a ballast to pressurize the sampled downhole fluid volume to be removed from microsampler 804. Alternatively, the center of microsampler 804 may have a ballast to swell with applied temperature or applied pressure or other energy, such as but not limited to electricity. An elastomer or a shape changing metal may be the center ballasting mechanism. A syringe pump may also provide the pressure to remove the sample from microsampler 804 via applied pressure to the ballast or direct pressure applied to the sample.

Figure 13:
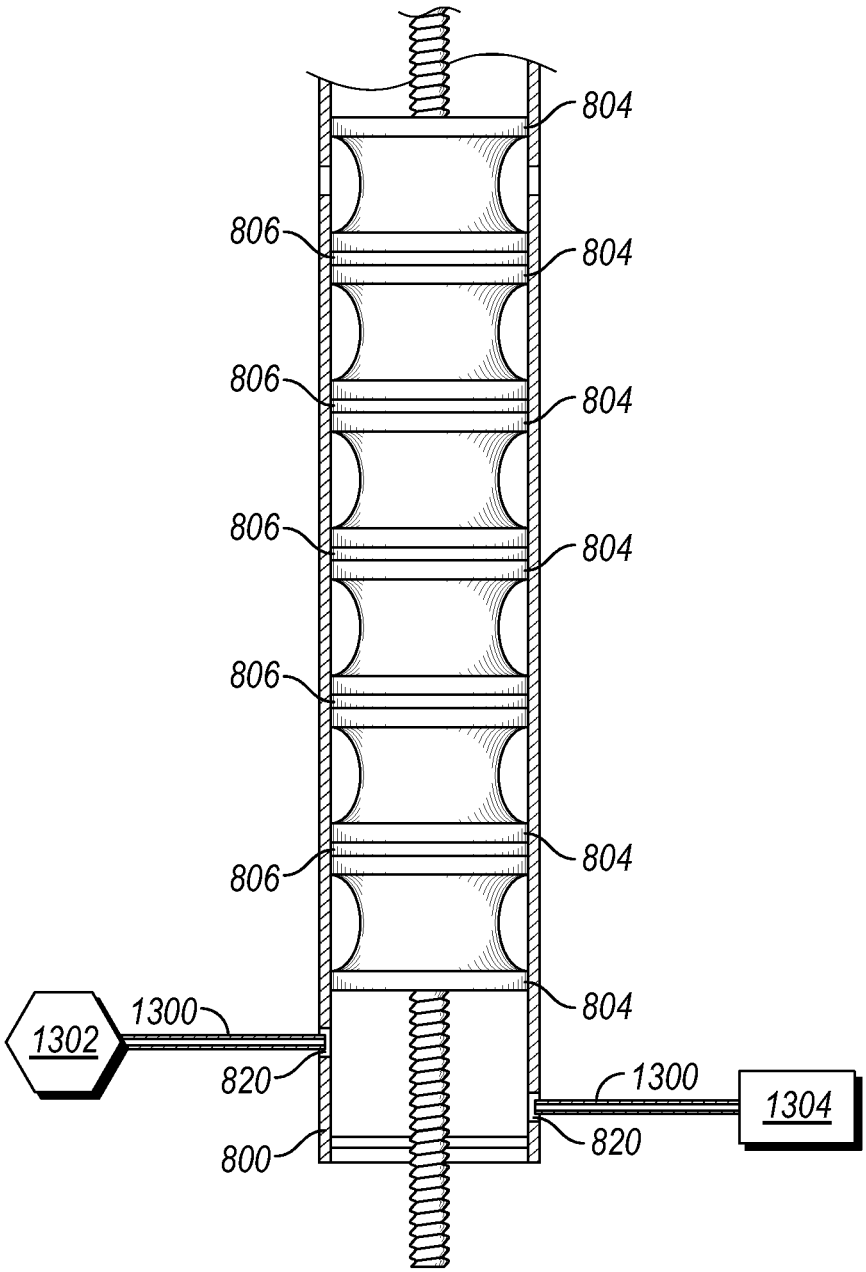
FIG. 13 illustrates removing a fluid sample from one or more microsamplers.

FIG. 13 illustrates removing a fluid sample from one or more microsamplers 804. As illustrated, microsampling device 734 may be disposed into a fitted receptacle in order to lock a capillary tubing 1300 into place. While FIG. 13 illustrates microsampling tube 800 in a vertical position, microsampling tube 800 may also be in a horizontal position to remove fluid samples from microsamplers 804. A syringe pump 1302 may provide the pressure to remove the fluid sample from microsampler 804 via applied pressure to the ballast or direct pressure applied to the fluid sample. In such a configuration, capillary ports 820 may be oriented with gravity to provide contact from the bottom with the denser fluid. Suitable fluids may be that of a different phase including but not limited to FC-40, silicon oil, or water. For water samples, a hydrocarbon fluid may be applied from the top. An inert gas may also be applied such that the inert gas may not affect the measurement. As illustrated, the fluid samples may be deposited into an analytical instrument 1304. Some analytical instrumentation injection systems may have a back pressure applied as such by syringe pump 1302. This back pressure allows the fluid sample to flow from microsampler 804 into analytical instrument 1304 in a controlled manner. The back pressure system may have a suitable immiscible phase fluid or may use a bit of the fluid sample itself to supply the back pressure. In examples, a trap (not illustrated) may be disposed on each capillary port 820 to capture an undesirable phase such as water during an oil injection. In examples, microsampler 804 may have an exit system that may also have an inline filter. In other examples, microsampler 804 may also be over heated in order to provide pressure to the fluid sample. Microsampling tube 800 may have a built-in heater in order to keep samples single phase. The microsampler may be vertical, horizontal or an angle therein or rotated with respect to capillary ports 820. Pressure may be generated by heating the sample such that the pressure is high enough to allow expansion of the fluid to fill the capillary tubing 1300 (or any other suitable conduit) in order to reach one or more fluid analysis devices. The samples may be introduced in parallel or series or a combination with fluid analytical devices. A backing fluid including but not limited to air, a miscible phase or immiscible phase may be used as a backing fluid to prevent the fractionation of the fluid and keep it suitable for analysis. The sampled fluid may also be allowed to fractionate. In this case, the resulting fluid flushes the connection line between the location where fractionation occurs and the analytical device by multiple volumes before entering the analytical device. Injection ports such as but not limited to six port valves may be used to introduce the fluid into the analytical device.

Figure 14:
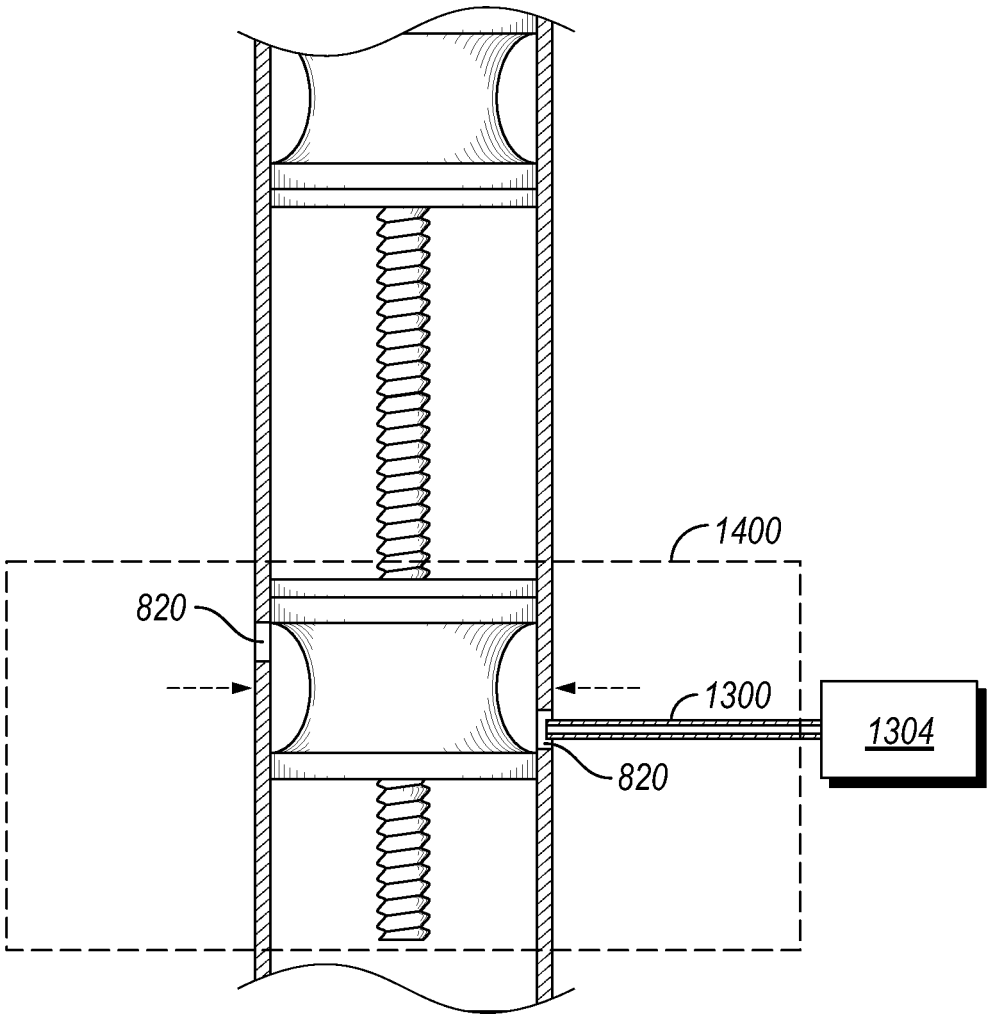
FIG. 14 illustrates another system for removing a fluid sample from one or more microsamplers.

FIG. 14 illustrates another example of removing a fluid sample from one or more microsamplers 804. In this example, microsampling tube 800 may be disposed at least partially in a housing 1400. Housing 1400 may comprise ballast to pressurize at least one capillary port 820 to force the fluid sampling into capillary tubing 1300. The ballast may swell with applied temperature or applied pressure or other energy, such as but not limited to electricity. An elastomer or a shape changing metal may be the center ballasting mechanism. As illustrated, microsampler 804 may be screwed and pushed into a separate system that has capillary inlets and outlets. This may be more convenient for providing a ballasting system.

In current technology, bulk samples generally collect many milliliters of fluid and up to one or more liters of fluid. This restricts how many fluid samples may be collected in a downhole sampling tool from a few fluid samples a tens of fluid samples per single run. The microsampling tool provides the ability to collect many tens to many hundreds of samples per run and in some embodiments even up to a thousand or so. With the capability to collect a large number of microsamples new possibilities in reservoir characterization and sample characterization are possible. For instance, many locations along a wellbore may be sampled in order to provide a dense characterization of the wellbore. Multiple analytical equipment may make use of microsamples including but not limited to gas chromatography, liquid chromatography, other chromatographic methods, mass spectroscopic methods, and some bulk physical properties including PVT and phase behavior properties from devices such as MEMS devices and microfluidic devices. Multiple samples may be taken along a single pumpout such as three to ten fluid samples (or more) allowing clean fluid properties of the reservoir fluid to be more easily deconvoluted from the mud properties. Therein samples may be of higher contamination than 1% or 10% contamination and still provide reliable deconvoluted reservoir properties. This analysis may be done in conjunction with bulk samples, and microsamples are used to extrapolate properties derived from the bulk sample. Multiple samples from a single station at near time such that the samples have similar contamination levels may be used to determine the repeatability of the microsample and provide statistical assessment of fluid properties.

The systems and methods for a microsampling device discussed above, may comprise any of the various features of the systems and methods disclosed herein, comprising one or more of the following statements.

Statement 1: A microsampling device for taking fluid samples in a wellbore. The microsampling device may comprise a microsampling tube in which one or more microsamplers disposed in the microsampling tube. Additionally, the microsampling device may comprise a fluid flow line connected to the microsampling tube in which a fluid sample traverses and a secondary fluid flow line in which at least a part of the fluid sample may traverse from the microsampling tube through the secondary fluid flow line and into a wellbore.

Statement 2: The microsampling device of statement 1, wherein the one or more microsamplers comprise a body and a top seal disposed at one end of the body and a bottom seal disposed at an opposite end of the top seal.

Statement 3: The microsampling device of statement 2, wherein the body is a concave shape and forms an annulus around the body.

Statement 4: The microsampling device of statement 2, wherein the body comprises a threaded corridor that traverses the body along a longitudinal axis.

Statement 5: The microsampling device of statement 4, wherein the threaded corridor may mate to a threaded rod, wherein the threaded rod is connected to at least one motor.

Statement 6: The microsampling device of statement 5, wherein the at least one motor rotates the threaded rod which moves the one or more microsamplers within the microsampling tube.

Statement 7: The microsampling device of statements 2 or 3, further comprising a plunger connected to at least one motor through a rod.

Statement 8: The microsampling device of claim 7, wherein the plunger is in contact with one of the one or more microsamplers.

Statement 9: The microsampling device of claim 8, wherein the at least one motor pushes the one or more microsamplers with the plunger through the microsampling tube.

Statement 10: The microsampling device of statements 2, 3, or 7, further comprising a wire connected to at least one of the one or more microsamplers and at least one motor.

Statement 11: The microsampling device of claim 10, wherein each of the one or more microsamplers are connected to each other.

Statements 12: The microsampling device of statement 10, wherein the at least one motor pulls the wire which pulls the one or more microsamplers through the microsampling tube.

Statement 13: The microsampling device of statements 1 or 2, wherein the one or more microsamplers are separated by at least one spacer.

Statement 14: The microsampling device of statements 1, 2, or 13, further comprising one or more capillary ports disposed in the microsampling tube.

Statement 15: The microsampling device of statement 14, further comprising at least one syringe pump connect to one of the one or more capillary ports.

Statement 16: The microsampling device of statement 15, further comprising an analytical instrument connected to a second of the capillary one or more ports.

Statement 17: The microsampling device of statement 14, further comprising a housing in which the microsampling tube is disposed.

Statement 18: The microsampling device of statement 17, further comprising an analytical instrument connected to a first capillary port of the capillary one or more ports.

Statement 19: The microsampling device of statement 18, wherein the housing further comprising a ballast that applies pressure to the fluid sample disposed in the microsampling tube to force the fluid sample into the analytical instrument through the first capillary port.

Statement 20: The microsampling device of statements 1, 2, 13, or 14, wherein the secondary fluid flow line comprises a first check valve and a second check valve.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any comprised range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A microsampling device comprising:

a microsampling tube;

one or more microsamplers disposed in the microsampling tube;

a fluid flow line connected to the microsampling tube in which a fluid sample traverses;

a secondary fluid flow line in which at least a part of the fluid sample may traverse from the microsampling tube through the secondary fluid flow line and into a wellbore; and one or more capillary ports disposed in the microsampling tube.

2. The microsampling device of claim 1, wherein the one or more microsamplers comprise a body and a top seal disposed at one end of the body and a bottom seal disposed at an opposite end of the top seal.

3. The microsampling device of claim 2, wherein the body is a concave shape and forms an annulus.

4. The microsampling device of claim 2, wherein the body comprises a threaded corridor that traverses the body along a longitudinal axis.

5. The microsampling device of claim 4, wherein the threaded corridor may mate to a threaded rod, wherein the threaded rod is connected to at least one motor.

6. The microsampling device of claim 5, wherein the at least one motor rotates the threaded rod which moves the one or more microsamplers within the microsampling tube.

7. The microsampling device of claim 2, further comprising a plunger connected to at least one motor through a rod.

8. The microsampling device of claim 7, wherein the plunger is in contact with one of the one or more microsamplers.

9. The microsampling device of claim 8, wherein the at least one motor pushes the one or more microsamplers with the plunger through the microsampling tube.

10. The microsampling device of claim 2, further comprising a wire connected to at least one of the one or more microsamplers and at least one motor.

11. The microsampling device of claim 10, wherein each of the one or more microsamplers are connected to each other.

12. The microsampling device of claim 10, wherein the at least one motor pulls the wire which pulls the one or more microsamplers through the microsampling tube.

13. The microsampling device of claim 1, wherein the one or more microsamplers are separated by at least one spacer.

14. The microsampling device of claim 1, further comprising at least one syringe pump connect to one of the one or more capillary ports.

15. The microsampling device of claim 14, further comprising an analytical instrument connected to a second of the capillary one or more ports.

16. The microsampling device of claim 1, further comprising a housing in which the microsampling tube is disposed.

17. The microsampling device of claim 16, further comprising an analytical instrument connected to a first capillary port of the capillary one or more ports.

18. The microsampling device of claim 17, wherein the housing further comprising a ballast that applies pressure to the fluid sample disposed in the microsampling tube to force the fluid sample into the analytical instrument through the first capillary port.

19. The microsampling device of claim 1, wherein the secondary fluid flow line comprises a first check valve and a second check valve.

* * * * *